US010400636B2

(12) United States Patent
Kim et al.

(10) Patent No.: US 10,400,636 B2
(45) Date of Patent: Sep. 3, 2019

(54) SUPERCRITICAL $CO_2$ GENERATION SYSTEM APPLYING PLURAL HEAT SOURCES

(71) Applicant: DOOSAN HEAVY INDUSTRIES & CONSTRUCTION CO., LTD., Changwon-si, Gyeongsangnam-do (KR)

(72) Inventors: Hak Soo Kim, Yongin-si (KR); Song Hun Cha, Osan-si (KR); Sang Hyeun Kim, Yongin-si (KR); Jun Tae Jang, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 167 days.

(21) Appl. No.: 15/293,996

(22) Filed: Oct. 14, 2016

(65) Prior Publication Data

US 2017/0107860 A1 Apr. 20, 2017

(30) Foreign Application Priority Data

Oct. 16, 2015 (KR) ..... 10-2015-0144892

(51) Int. Cl.
*F01K 7/16* (2006.01)
*F01K 7/32* (2006.01)
(Continued)

(52) U.S. Cl.
CPC ..... *F01K 25/103* (2013.01); *F01K 7/16* (2013.01); *F01K 7/32* (2013.01); *F01K 13/00* (2013.01);
(Continued)

(58) Field of Classification Search
CPC ..... F01K 25/103; F01K 27/02; F01K 13/00; F01K 13/006; F01K 13/02; F01K 25/08;
(Continued)

(56) References Cited

U.S. PATENT DOCUMENTS 5,038,568 A * 8/1991 Gounder ..... F01K 7/22 60/663
8,857,186 B2 * 10/2014 Held ..... F01K 25/08 60/655
(Continued)

FOREIGN PATENT DOCUMENTS

JP 5857013 A 4/1983
JP 0642703 A 2/1994
(Continued)

OTHER PUBLICATIONS

Communication dated Jan. 31, 2017 from the Korean Intellectual Property Office in counterpart Korean application No. 10-2015-0144892.

*Primary Examiner* — Mark A Laurenzi
*Assistant Examiner* — Xiaoting Hu
(74) *Attorney, Agent, or Firm* — INVENSTONE Patent, LLC

(57) ABSTRACT

A supercritical $CO_2$ generation system using plural heat sources, includes: a pump configured to circulate a working fluid; heat exchangers configured to heat the working fluid using an external heat source; turbines configured to be driven by the working fluid heated by passing through the heat exchanger; and recuperators configured to exchange heat between the working fluid passing through the turbine and the working fluid passing through the pump to cool the working fluid passing through the turbine, in which the heat exchanger includes constrained heat exchangers having an emission regulation condition of an outlet end and heat exchangers without the emission regulation condition.

20 Claims, 2 Drawing Sheets

(51) Int. Cl.
*F01K 25/10* (2006.01)
*F01K 13/00* (2006.01)
*F01K 13/02* (2006.01)

(52) U.S. Cl.
CPC ..... *F01K 13/006* (2013.01); *F01K 13/02* (2013.01); *F01K 25/10* (2013.01)

(58) Field of Classification Search
CPC ..... F01K 25/10; F01K 25/106; F01K 7/16; F01K 7/32; F01K 7/38; F01K 7/40; F01K 7/42; F01K 11/02; F22D 1/32
See application file for complete search history.

(56) References Cited

U.S. PATENT DOCUMENTS 9,359,919 B1* 6/2016 Berry ..... F01K 25/106
9,441,504 B2* 9/2016 Held ..... F01K 23/10
9,874,112 B2* 1/2018 Giegel ..... F01K 7/40
2006/0112692 A1* 6/2006 Sundel ..... F01K 15/04 60/670
2010/0146972 A1* 6/2010 Sorita ..... C04B 7/47 60/653
2012/0131920 A1* 5/2012 Held ..... F01K 13/02 60/650
2013/0145759 A1* 6/2013 Sonwane ..... F01K 25/103 60/526
2014/0102098 A1 4/2014 Bowan et al.
2014/0102101 A1* 4/2014 Xie ..... F01K 25/103 60/647
2014/0208750 A1* 7/2014 Vermeersch ..... F01K 13/02 60/646
2014/0298809 A1* 10/2014 Sorida ..... F01K 7/18 60/643
2016/0003108 A1* 1/2016 Held ..... F01K 23/10 60/517
2016/0047361 A1* 2/2016 Al-Sulaiman ..... F01K 23/02 60/641.15
2016/0237859 A1* 8/2016 Malinin ..... F01K 3/185
2016/0326916 A1* 11/2016 Roh ..... F02C 1/08

FOREIGN PATENT DOCUMENTS

JP 2012-145092 A 8/2012
KR 10-2014-0064704 A 5/2014

* cited by examiner

SUPERCRITICAL $CO_2$ GENERATION SYSTEM APPLYING PLURAL HEAT SOURCES

CROSS-REFERENCE TO RELATED APPLICATION

This application claims priority to Korean Patent Application No. 10-2015-0144892, filed on Oct. 16, 2015, the disclosure of which is incorporated herein by reference in its entirety.

BACKGROUND

Field of the Invention

Exemplary embodiments of the present disclosure relate to a supercritical $CO_2$ generation system applying plural heat sources, and more particularly, to a supercritical $CO_2$ generation system applying plural heat sources capable of efficiently disposing and operating a heat exchanger depending on conditions of the heat sources.

Description of the Related Art

As a necessity for efficient power production is increased internationally and activities for reducing the generation of pollutants are activated, various efforts to increase power production while reducing the generation of pollutants have been conducted. As one of the efforts, research and development for a power generation system using the supercritical $CO_2$ as a working fluid as disclosed in Japanese Patent Laid-Open Publication No. 2012-145092 has been actively conducted.

The supercritical $CO_2$ has a density similar to a liquid state and viscosity similar to gas, such that apparatuses may be miniaturized and power consumption required to compress and circulate a fluid may be minimized. Meanwhile, the supercritical $CO_2$ having a critical point of 31.4° C. and 72.8 atmosphere are much lower than water having a critical point of 373.95° C. and 217.7 atmosphere and therefore may very easily be handled. The supercritical $CO_2$ generation system may show pure power generation efficiency of about 45% when being operated at 550° C. and have at least 20% increase in power generation efficiency compared to that of the existing steam cycle and reduce a size of a turbo apparatus to a level of 1:tens.

When plural heat sources having constraints is applied, the system configuration is complicated and it is difficult to effectively use heat, and as a result most of the supercritical $CO_2$ generation systems have one heater which is a heat source. Therefore, there is a problem in that the system configuration is restrictive and it is difficult to effectively use the heat source.

RELATED ART DOCUMENT

Patent Document (Patent Document 1) Japanese Patent Laid-open Publication No. 2012-145092 (Published on Aug. 2, 2012)

SUMMARY

An object of the present disclosure is to provide a supercritical $CO_2$ generation system applying plural heat sources capable of effectively disposing and operating a heat exchanger depending on conditions of the heat sources.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect, there is provided a supercritical $CO_2$ generation system using plural heat sources, including: a pump configured to circulate a working fluid; plural heat exchangers configured to heat the working fluid using an external heat source; plural turbines configured to be driven by the working fluid heated by passing through the heat exchanger; and plural recuperators configured to exchange heat between the working fluid passing through the turbine and the working fluid passing through the pump to cool the working fluid passing through the turbine, in which the heat exchanger includes plural constrained heat exchangers having an emission regulation condition of an outlet end and plural heat exchangers without the emission regulation condition.

The emission regulation condition may be a temperature condition.

The number of recuperators may be the same as the number of heat exchangers or smaller than the number of heat exchangers.

The turbine may include a low temperature turbine driving the pump and a high temperature turbine driving a power generator.

An integrated flux $mt_0$ of the working fluids passing through the low temperature turbine and the high temperature turbine may be branched to be supplied to the plurality of recuperators.

The supercritical $CO_2$ generation system may further include: a three way valve installed at a branched point of a transfer tube to which the working fluid is transferred to branch the working fluid.

The heat exchanger may include a first constrained heat exchanger and a second constrained heat exchanger, and when any one of the first constrained heat exchanger and the second constrained heat exchanger has the emission regulation condition having temperature higher than that of the other thereof, the integrated flux $mt_0$ of the working fluid transferred to the heat exchanger having the emission regulation condition of the higher temperature of the first constrained heat exchanger and the second constrained heat exchanger may be more than the integrated flux $mt_0$ of the working fluid transferred to the heat exchanger having the emission regulation condition of the lower temperature thereof.

The heat exchanger may further include a first heat exchanger and a second heat exchanger, a front end of the pump may be further provided with a cooler cooling the working fluid passing through the recuperator, and the working fluid passing through the pump may be heated by passing through the first heat exchanger and the second heat exchanger to be transferred to the low temperature turbine and the high temperature turbine.

The heat exchanger may include a first constrained heat exchanger and a second constrained heat exchanger, and when the first constrained heat exchanger and the second constrained heat exchanger have the emission regulation condition of the same temperature, the integrated flow $mt_0$ of the working fluid may be equally distributed to the first constrained heat exchanger and the second constrained heat exchanger.

The heat exchanger may further include a first heat exchanger and a second heat exchanger, a front end of the pump may be further provided with a cooler cooling the working fluid passing through the recuperator, and the working fluid passing through the pump may be heated by passing through the first heat exchanger and the second heat exchanger to be transferred to the low temperature turbine and the high temperature turbine.

The working fluids passing through the first constrained heat exchanger and the second constrained heat exchanger may be introduced into the turbine.

In accordance with another aspect of the present disclosure, there is provided a supercritical $CO_2$ generation system using plural heat sources, including: a pump configured to circulate a working fluid; plural heat exchangers configured to heat the working fluid using an external heat source; plural turbines configured to be driven by the working fluid heated by passing through the heat exchanger; and plural recuperators configured to be introduced with the working fluid passing through the turbine and exchange heat between the working fluid passing through the turbine and the working fluid passing through the pump to cool the working fluid passing through the turbine, in which the heat exchanger includes plural constrained heat exchangers having an emission regulation condition of an outlet end and plural heat exchangers without the emission regulation condition.

The emission regulation condition may be a temperature condition.

The number of recuperators may be the same as the number of heat exchangers or smaller than the number of heat exchangers.

The turbine may include a low temperature turbine driving the pump and a high temperature turbine driving a power generator.

The supercritical $CO_2$ generation system may further include: a separate transfer tube configured to supply the working fluids passing through each of the low temperature turbine and the high temperature turbine to each of the plurality of recuperators.

The constrained heat exchanger may include a first constrained heat exchanger and a second constrained heat exchanger, and when any one of the first constrained heat exchanger and the second constrained heat exchanger has the emission regulation condition having temperature higher than that of the other thereof, the constrained heat exchanger may be connected to the transfer tube transferring a working fluid $mt_2$ passing through the high temperature turbine to the heat exchanger having the emission regulation condition of the higher temperature of the first constrained heat exchanger and the second constrained heat exchanger.

The heat exchanger may further include a first heat exchanger and a second heat exchanger and a front end of the pump may further include a cooler cooling the working fluid passing through the recuperator.

The working fluid passing through the pump may be heated by passing through the first heat exchanger and the second heat exchanger to be transferred to the low temperature turbine and the high temperature turbine.

The working fluids passing through the first constrained heat exchanger and the second constrained heat exchanger may be introduced into the turbine.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Hereinafter, a supercritical $CO_2$ generation system applying plural heat sources according to an exemplary embodiment will be described in detail with reference to the accompanying drawings.

Generally, the supercritical $CO_2$ generation system forms a close cycle in which $CO_2$ used for power generation is not emitted to the outside and uses the supercritical $CO_2$ as a working fluid.

The supercritical $CO_2$ generation system uses the $CO_2$ as the working fluid and therefore may use exhaust gas emitted from a thermal power plant, etc., such that it may be used in a single generation system and a hybrid generation system with the thermal generation system. The working fluid of the supercritical $CO_2$ generation system may also supply $CO_2$ separated from the exhaust gas and may also supply separate $CO_2$.

The supercritical $CO_2$ (hereinafter, working fluid) within the cycle passes through a compressor and then is heated while passing through a heat source such as a heater to be in a high temperature and pressure state, and therefore the working fluid may drive a turbine. The turbine is connected to a power generator or a pump, in which the turbine connected to the power generator produces power and the turbine connected to the pump drives the pump. The working fluid passing through the turbine is cooled while passing through a heat exchanger and the cooled working fluid is again supplied to the compressor to be circulated within the cycle. The turbine or the heat exchanger may be provided in plural.

The present disclosure proposes a supercritical $CO_2$ generation system which includes plural heaters using waste heat gas as a heat source and operates the recuperators equal to smaller than the number of heat sources by effectively disposing each heat exchanger depending on conditions such as temperature of an inlet and an outlet and capacity and the heat source and the number of heat sources.

The supercritical $CO_2$ generation system according to various exemplary embodiments of the present disclosure is used as a meaning including a system that all the working fluids flowing within the cycle are in the supercritical state and a system that most of the working fluids are in the supercritical state and the rest of the working fluids are in a subcritical state.

Further, according to various exemplary embodiments of the present disclosure, the $CO_2$ is used as the working fluid. Here, the $CO_2$ is used as a meaning including pure $CO_2$ in a chemical meaning, $CO_2$ somewhat including impurities in general terms, and a fluid in a state in which more than one fluid as additives is mixed with $CO_2$.

Figure 1:
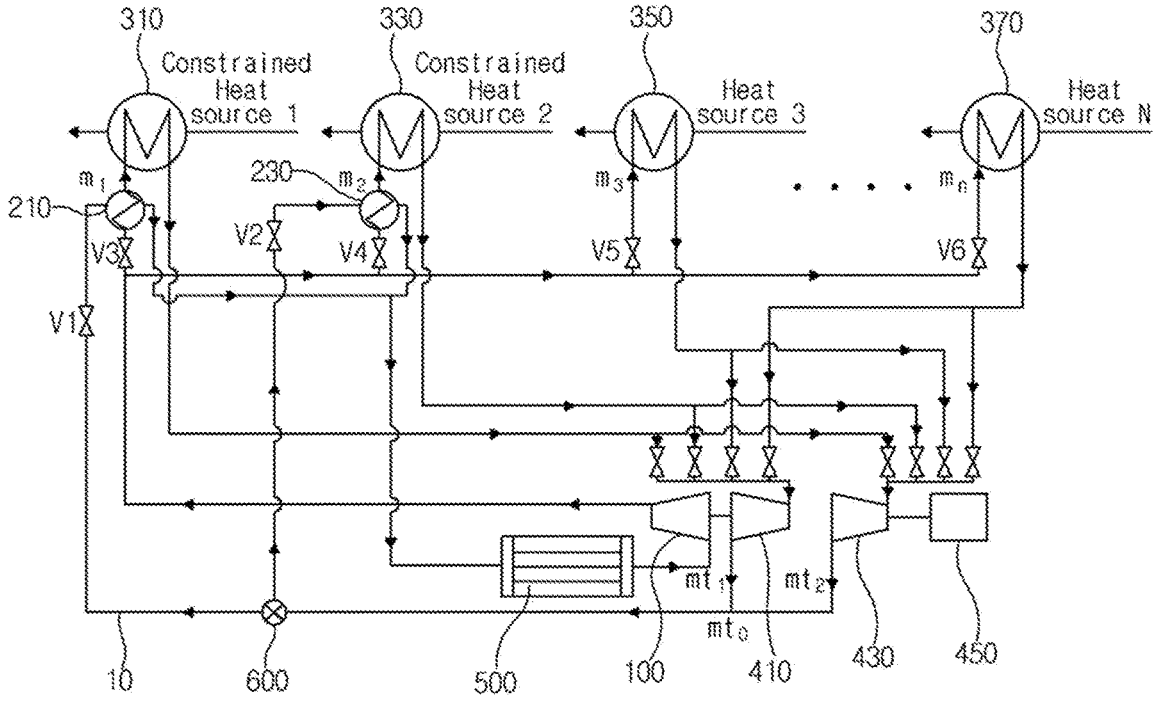
FIG. 1 is a schematic diagram illustrating a supercritical $CO_2$ generation system according to an exemplary embodiment.

FIG. 1 is a schematic diagram illustrating a supercritical $CO_2$ generation system according to an exemplary embodiment of the present disclosure.

As illustrated in FIG. 1, a supercritical $CO_2$ generation system according to an exemplary embodiment of the present disclosure may be configured to include a pump 100 configured to pass through the working fluid, plural recuperators and plural heat sources configured to exchange heat with the working fluid passing through the pump 100, plural turbines 410 and 430 configured to be driven by the working fluid heated by passing through the recuperators and the heat sources, a power generator 450 configured to be driven by the turbines 410 and 430, and a cooler 500 configured to cool the working fluid introduced into the pump 100.

Each of the components of the present disclosure is connected to each other by a transfer tube through which the working fluid flows and unless specially mentioned, it is to be understood that the working fluid flows along the transfer tube. However, when plural components are integrated, the integrated configuration may include a part or an area actually serving as the transfer tube. Therefore, even in this case, it is to be understood that the working fluid flows along the transfer tube 10. A channel performing a separate function will be described additionally.

The pump 100 is driven by a low temperature turbine 410 to be described below and serves as transmitting the low temperature working fluid cooled by the cooler 500 to the recuperator.

The recuperator exchanges heat with the working fluid cooled from a high temperature to a middle temperature while the working fluid is expanded by passing through the turbines 410 and 430, thereby primarily cooling the working fluid. An inlet end into which the working fluid passing through the turbines 410 and 430 is introduced may be provided with control valves v1 and v2. The cooled working fluid is transferred to the cooler 500, secondarily cooled, and then transferred to the pump 100. The working fluid transferred to the recuperator through the pump 100 exchanges heat with the working fluid passing through the turbines 410 and 430 to be primarily heated and is supplied to the heat source to be described below. For this purpose, the inlet end of the transfer tube 10 into which the working fluid transferred from the pump 100 to the recuperator is introduced may be provided with control valves v3 and v4. According to the exemplary embodiment of the present disclosure, the recuperator may be provided in a number equal to or smaller than the number of heat sources and the exemplary embodiment of the present disclosure describes the example in which two recuperators are provided.

A first recuperator 210 may be provided before the inlet end into which the working fluid transferred to a first constrained heat exchanger 310 to be described below is introduced and a second recuperator 230 may be provided before the inlet end into which the working fluid transferred to a second constrained heat exchanger 330 to be described below is introduced.

An integrated flux $mt_0$ (hereinafter, defined as an integrated flux) of a flux $mt_1$ of a fluid passing through the high temperature turbine 430 and a flux $mt_2$ of a fluid passing through the low temperature turbine 410 is branched and introduced into the first recuperator 210 and the second recuperator 230. A separate controller (not illustrated) controls how much the integrated flux $mt_0$ of the working fluid is branched into the first recuperator 210 and the second recuperator 230 and a branched point of the transfer tube 10 may be provided with a three way valve 600 for branch.

The heat source recovers waste heat to heat the working fluid and may be configured of plural constrained heat sources in which an emission condition of emitted waste heat gas is defined and plural general heat sources in which the emission condition is not defined. In the present specification, for convenience, an example in which a first constrained heat source 1 (310) and a second constrained heat source 2 (330) are provided as a constrained heat source and a heat exchanger 350 and a second heat exchanger 370 are provided as a general heat source will be described.

The first constrained heat exchanger 310 uses gas (hereinafter, waste heat gas) having waste heat like exhaust gas combusted and then emitted by a boiler as the heat source and is a heat source having emission regulation conditions upon the emission of the waste heat gas. The emission regulation condition is a temperature condition (flux of the working fluid introduced from the first recuperator 210 to the first constrained heat exchanger 310 is defined as $m_1$) and the temperature of the waste heat gas introduced into the first constrained heat exchanger 310 may be relatively lower than that of the waste heat gas introduced into the first heat exchanger 350 to be described below. The first constrained heat exchanger 310 heats the working fluid passing through the first recuperator 210 using the heat of the waste heat gas. The waste heat gas from which the heat is taken away by the first constrained heat exchanger 310 is cooled at a temperature meeting the emission regulation condition and then exits the first constrained heat exchanger 310.

The second constrained heat exchanger 330 is also the same heat source as the first constrained heat exchanger 310 and is the heat source having the emission regulation conditions upon the emission of the waste heat gas. The emission regulation conditions of the second constrained heat exchanger 330 is the temperature condition (flux of the working fluid introduced into the second constrained heat exchanger 330 from the second recuperator 230 is defined as $m_2$) and the temperature of the waste heat gas introduced into the second constrained heat exchanger 330 may be relatively lower than that of the waste heat gas introduced into the first heat exchanger 350 to be described below. The second constrained heat exchanger 330 may have the emission regulation conditions different from those of the first constrained heat exchanger 310 and may also have the same emission regulation conditions. The second constrained heat exchanger 330 heats the working fluid passing through the second recuperator 230 using the heat of the waste heat gas. The waste heat gas from which the heat is taken away by the second constrained heat exchanger 330 is cooled at a temperature meeting the emission regulation condition and then exits the second constrained heat exchanger 330.

The working fluid heated by passing through the first constrained heat exchanger 310 and the second constrained heat exchanger 330 is supplied to the low temperature turbine 410 and the high temperature turbine 430 to drive the turbines 410 and 430. For this purpose, front ends of the turbines 410 and 430 are provided with control valves (no numerals).

The first heat exchanger 350 and the second heat exchanger 370 exchanges heat between the waste heat gas and the working fluid to serve to heat the working fluid and is a heat source without the emission regulation conditions. The heat source without the emission regulation conditions may correspond to, for example, an AQC waste heat condition in a cement process. The working fluid cooled by passing through the pump 100 is transferred to the first heat exchanger 350 and the second heat exchanger 370 to exchange heat with the waste heat gas and to be heated at high temperature. The working fluid heated by passing through the first heat exchanger 350 and the second heat exchanger 370 is supplied to the high temperature turbine 430 and the low temperature turbine 410 to be described below. Alternatively, the working fluid passing through the pump 100 passes through the first recuperator 210 and the second recuperator 230 and then may also be heated by the first constrained heat exchanger 310 and the second constrained heat exchanger 330.

The turbines 410 and 430 are configured of the high temperature turbine 410 and the low temperature turbine 410 and are driven by the working fluid to drive the power generator 450 connected at least one of the turbines, thereby generating power. The working fluid is expanded while passing through the high temperature turbine 430 and the low temperature turbine 410, and therefore the turbines 410 and 430 also serves as an expander. According to the exemplary embodiment of the present disclosure, the high temperature turbine 430 is connected to the high temperature turbine 430 to produce power and the low temperature turbine 410 serves to drive the pump 100.

Here, the terms high temperature turbine 430 and low temperature turbine 410 have a relative meaning to each other and therefore, it is to be noted that that they are not understood as having the meaning that temperature higher than a specific temperature as a reference value is a high temperature and temperature lower than that is a low temperature.

The emission regulation conditions of the first constrained heat exchanger 310 and the second constrained heat exchanger 330 are tight or the larger the flux of the waste heat gas introduced into the first constrained heat exchanger 310 and the second constrained heat exchanger 330, the larger the required heat capacity.

Here, the case in which the heat capacity of the first constrained heat exchanger 310 and the second constrained heat exchanger 330 is large means the case in which the heat capacity required by the first recuperator 210 and the second recuperator 230 at the inlet ends of the cooling fluid introduced into the first constrained heat exchanger 310 and the second constrained heat exchanger 330 is large. This corresponds to the case in which the heat energy of the integrated flux $mt_0$ may be used maximally and means the case in which the integrated flux $mt_0$ that is the fluxes $m_1$ and $m_2$ of the working fluid introduced into the first constrained heat exchanger 310 and the second constrained heat exchanger 330 may be sufficiently heated by the first recuperator 210 and the second recuperator 230.

By doing so, when the heat capacity required in the first constrained heat exchanger 310 and the second constrained heat exchanger 330 is large and the emission regulation conditions of the first constrained heat exchanger 310 and the second constrained heat exchanger 330 are similar to each other, a small number of large-capacity recuperators may be used. The number of recuperator may be smaller than the number of first constrained heat exchanger 310 and second constrained heat exchanger 330. In this case, the integrated flux $mt_0$ of the working fluid is equally distributed and transferred to the first recuperator 210 and the second recuperator 230, thereby heating the working fluid while satisfying the emission regulation conditions of the waste heat gas.

Further, when the heat capacity required in the first constrained heat exchanger 310 and the second constrained heat exchanger 330 is large and the emission regulation conditions of the first constrained heat exchanger 310 and the second constrained heat exchanger 330 are different from each other, a large number of small-capacity recuperators may be used. The recuperator may be equal to the number of first constrained heat exchanger 310 and second constrained heat exchanger 330. In this case, the integrated flux $mt_0$ of the working fluid is properly distributed depending on the emission regulation conditions of the first constrained heat exchanger 310 and the second constrained heat exchanger 330 to be transferred to the first recuperator 210 and the second recuperator 230, thereby heating the working fluid while satisfying the emission regulation conditions.

In the supercritical $CO_2$ generation system according to the exemplary embodiment of the present disclosure having the above configuration, the detailed example of the flow of the working fluid will be described as follows.

The working fluid cooled by the cooler 500 is circulated by the pump 100 to be branched and transferred to the first recuperator 210 and the second recuperator 230, respectively, through the control valves v3 and v4. The flux $m_1$ of the working fluid transferred to the first recuperator 210 and the flux $m_2$ of the working fluid transferred to the second recuperator 230 may be different depending on the emission regulation conditions of the first constrained heat exchanger 310 and the second constrained heat exchanger 330.

The working fluids branched into the first recuperator 210 and the second recuperator 230, respectively, are branched from the integrated flux $mt_0$ of the working fluid passing through the low temperature turbine 410 and the high temperature turbine 430 and exchange heat with the working fluids passing through the first recuperator 210 and the second recuperator 230, respectively to be primarily heated.

Next, the working fluids passing through the first recuperator 210 and the second recuperator 230, respectively, are transferred to the first constrained heat exchanger 310 and the second constrained heat exchanger 330, respectively and exchange heat with the waste heat gas to be secondarily heated. In this case, the emission regulation conditions of the waste heat gas of the first constrained heat exchanger 310 and the second constrained heat exchanger 330 may be similar to each other as about 200° C. and the integrated flux $mt_0$ may be equally branched and transferred to the first constrained heat exchanger 310 and the second constrained heat exchanger 330. Further, the waste heat gas introduced into the first constrained heat exchanger 310 and the second constrained heat exchanger 330 may be middle-temperature waste heat gas relatively lower than the temperature of the waste heat gas introduced into the first heat exchanger 350 and the second heat exchanger 370.

The high-temperature working fluid $m_1$ passing through the first constrained heat exchanger 310 is transferred to the low temperature turbine 410 or the high temperature turbine 430 to drive the low temperature turbine 410 and the high temperature turbine 430. The high-temperature working fluid $m_2$ passing through the first constrained heat exchanger 330 is also transferred to the low temperature turbine 410 or the high temperature turbine 430 to drive the low temperature turbine 410 and the high temperature turbine 430. The above-mentioned controller determines which of the turbines 410 and 430 is driven by the high-temperature working fluid depending on operation conditions.

Alternatively, the working fluid may also be transferred directly to the first heat exchanger 350 and the second heat exchanger 370 through the pump 100 without passing through the first recuperator 210 and the second recuperator 230. The first heat exchanger 350 and the second heat exchanger 370 are the heat source without the emission regulation conditions of the waste heat gas and may be a heat source using the high-temperature waste heat gas relatively higher than that of the waste heat gas introduced into the first constrained heat exchanger 310 and the second constrained heat exchanger 330. The low-temperature working fluid is heated by passing through the first heat exchanger 350 and the second heat exchanger 370 and then transferred to the low temperature turbine 410 or the high temperature turbine 430 to drive the low temperature turbine 410 and the high temperature turbine 430. The above-mentioned controller determines which of the turbines 410 and 430 is driven by the high-temperature working fluid depending on operation conditions.

The middle-temperature working fluid $mt_0$ expanded by passing through the low temperature turbine 410 and the high temperature turbine 430 is supplied while being branched into the first recuperator 210 and the second recuperator 230 and is cooled by exchanging heat with the low-temperature working fluid passing through the pump 100 and then is introduced into the cooler 500.

Here, the low temperature, the middle temperature, and the high temperature have a relative meaning and it is to be noted that that they are not understood as having the meaning that temperature higher than a specific temperature as a reference value is a high temperature and temperature lower than that is a low temperature Generally, the output of the high temperature turbine 430 driving the power generator 450 is higher than that of the low temperature turbine 410 driving the pump 100, and therefore the working fluid that becomes the middle temperature state by passing through the first constrained heat exchanger 310 and the second constrained heat exchanger 330 is preferably transferred to the low temperature turbine 410. As a result, the working fluid passing through the first heat exchanger 350 and the second heat exchanger 370 that are in the relatively higher temperature state than the first constrained heat exchanger 310 and the second constrained heat exchanger 330 is preferably transferred to the high temperature turbine 430.

However, the determination on to which of the turbines 410 and 430 the middle-temperature working fluid or the high-temperature working fluid will be transferred may be different depending on the operation conditions and the emission regulation conditions of the waste heat gas.

The example in which the integrated flux of the working fluids passing through the low temperature turbine and the high temperature turbine is branched and transferred to the first recuperator and the second recuperator is described above, but the fluxes of each of the low temperature turbine and the high temperature turbine may also be transferred to the first recuperator and the second recuperator (the same components as the foregoing exemplary embodiment will be described with reference to the same reference numerals and the detailed description thereof will be omitted).

Figure 2:
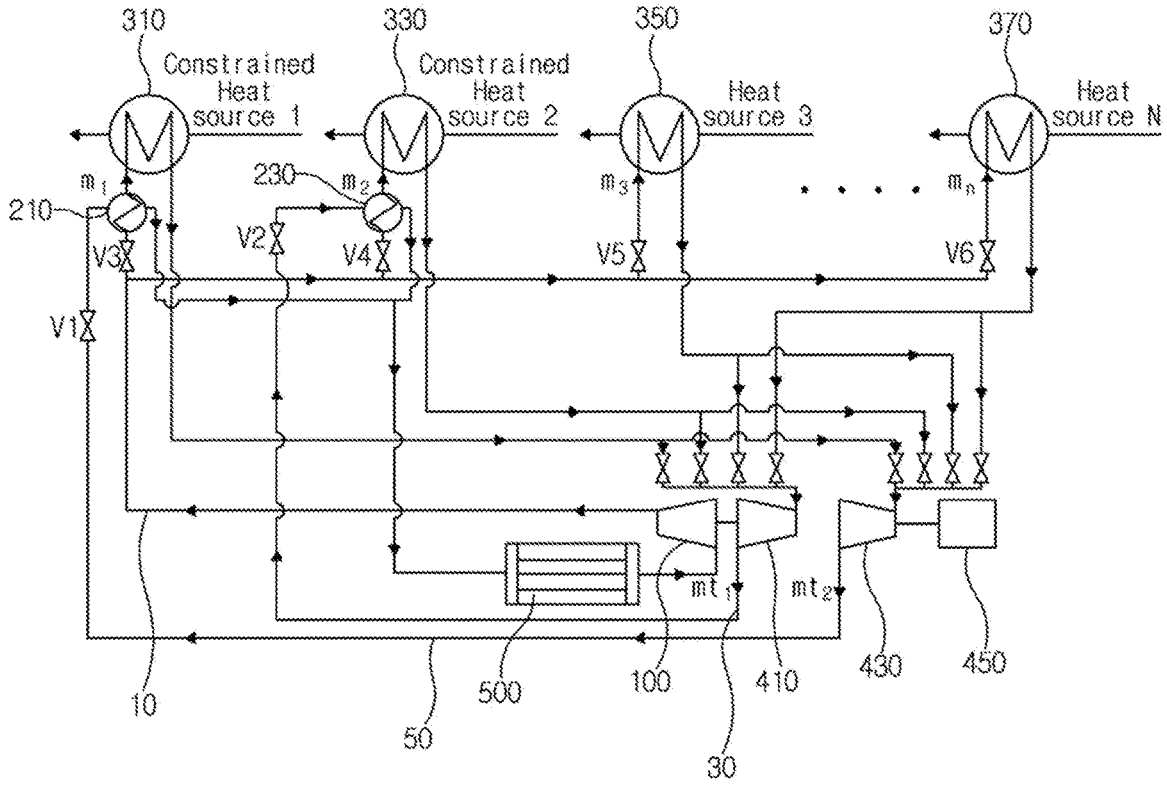
FIG. 2 is a schematic diagram illustrating a supercritical $CO_2$ generation system according to another exemplary embodiment.

FIG. 2 is a schematic diagram illustrating a supercritical $CO_2$ generation system according to another exemplary embodiment of the present disclosure.

As illustrated in FIG. 2, the supercritical $CO_2$ generation system according to another exemplary embodiment of the present disclosure may transfer a working fluid $mt_1$ passing through the low temperature turbine 410 to the second constrained heat exchanger 330 and transfer a working fluid $mt_2$ passing through the high temperature turbine 430 to the first constrained heat exchanger 310.

For example, the case in which the emission regulation conditions of the first constrained heat exchanger 310 is 220° C. and the emission regulation conditions of the second constrained heat exchanger 330 is 200° C. may be assumed. In this case, as the foregoing exemplary embodiments, the emission regulation conditions may also be satisfied by the branched amount of the integrated flux $mt_0$ and as the exemplary embodiment of the present disclosure, the working fluid having different temperatures may be supplied to satisfy the emission regulation conditions.

That is, to operate the power generator 450, the working fluid emitted from the high temperature turbine 430 to which the working fluid having a relatively higher temperature than the low temperature turbine 410 is supplied is supplied to the first constrained heat exchanger 310 through a separate transfer tube 50, such that the heat exchange with the waste heat gas may be less generated than in the second constrained heat exchanger 330. Further, the working fluid emitted from the low temperature turbine 410 to which the working fluid having a relatively lower temperature than the high temperature turbine 430 is supplied is supplied to the second constrained heat exchanger 330 through a separate transfer tube 30, such that the heat exchange with the waste heat gas may be less generated than in the first constrained heat exchanger 310.

By the principle, the working fluid is heated while satisfying the emission regulation conditions of the waste heat gas of the first constrained heat exchanger 310 and the second constrained heat exchanger 330, respectively, and may be supplied to the turbines 410 and 430.

According to the exemplary embodiment of the present disclosure, the respective heat exchangers may be effectively disposed depending on the conditions such as the temperature of the inlet and outlet of the heat source, the capacity of the heat source, and the number of heat sources, and thus the recuperator equal to or smaller than the number of heat sources may be used, such that the configuration of the system may be simplified and the system may be effectively operated.

According to the supercritical $CO_2$ generation system applying plural heat sources in accordance with the exemplary embodiments of the present disclosure, the respective heat exchangers may be effectively disposed depending on the conditions such as the temperature of the inlet and outlet of the heat source, the capacity of the heat source, and the number of heat sources, and thus the recuperator equal to or smaller than the number of heat sources may be used, such that the configuration of the system may be simplified and the system may be effectively operated.

The various exemplary embodiments of the present disclosure, which is described as above and shown in the drawings, should not be interpreted as limiting the technical spirit of the present disclosure. The scope of the present disclosure is limited only by matters set forth in the claims and those skilled in the art can modify and change the technical subjects of the present disclosure in various forms. Therefore, as long as these improvements and changes are apparent to those skilled in the art, they are included in the protective scope of the present invention.

What is claimed is:

1. A supercritical $CO_2$ generation system using plural heat sources including plural constrained heat sources in which an emission regulation condition of emitted waste heat gas is defined and plural general heat sources in which the emission regulation condition is not defined, comprising:

a pump configured to circulate a working fluid;

a plurality of heat exchangers respectively configured to heat the working fluid using the plural heat sources, the plurality of heat exchangers including plural constrained heat exchangers that are respectively connected to the plural constrained heat sources and that each include an outlet end for discharging waste heat gas according to the emission regulation condition, and plural general heat exchangers that are respectively connected to the plural general heat sources and that each include an outlet end for outputting waste heat gas irrespective of the emission regulation condition;

turbines configured to be driven by the working fluid heated by passing through the plurality of heat exchangers; and a plurality of recuperators configured to exchange heat between the working fluid passing through the turbines and the working fluid passing through the pump to cool the working fluid passing through the turbines, wherein the working fluid is supplied to the plural constrained heat exchangers by passing through the plurality of recuperators, respectively, and to at least one of the plural general heat exchangers without passing through the plurality of recuperators.

2. The supercritical $CO_2$ generation system of claim 1, wherein the emission regulation condition is a temperature condition.

3. The supercritical $CO_2$ generation system of claim 2, wherein the plurality of recuperators include a number of recuperators that is not more than a number of the plural constrained heat exchangers.

4. The supercritical $CO_2$ generation system of claim 3, wherein the turbines include a low temperature turbine driving the pump and a high temperature turbine driving a power generator.

5. The supercritical $CO_2$ generation system of claim 4, wherein the plurality of recuperators include two recuperators, and the working fluids passing through the low temperature turbine and the high temperature turbine are combined into an integrated flux $mt_0$ that is branched to be respectively supplied to the two recuperators.

6. The supercritical $CO_2$ generation system of claim 5, further comprising:

a three way valve installed at a branched point of a transfer tube to which the working fluid is transferred to branch the working fluid.

7. The supercritical $CO_2$ generation system of claim 5, wherein the plural constrained heat exchangers include a first constrained heat exchanger and a second constrained heat exchanger, and wherein, when the emission regulation condition of one of the first constrained heat exchanger or the second constrained heat exchanger is a temperature higher than that of the other, an amount of the integrated flux $mt_0$ of the working fluid branched to the recuperator of the constrained heat exchanger of the higher temperature is greater than an amount of the integrated flux $mt_0$ of the working fluid branched to the recuperator of the constrained heat exchanger of the lower temperature.

8. The supercritical $CO_2$ generation system of claim 5, wherein the plural constrained heat exchangers include a first constrained heat exchanger and a second constrained heat exchanger, and wherein, when the emission regulation conditions of the first constrained heat exchanger and the second constrained heat exchanger are the same temperature, an amount of the integrated flux $mt_0$ of the working fluid branched to the recuperator of the first constrained heat exchanger is equal to an amount of the integrated flux $mt_0$ of the working fluid branched to the recuperator of the second constrained heat exchanger.

9. The supercritical $CO_2$ generation system of claim 8, further comprising a cooler provided to a front end of the pump and configured to cool the working fluid passing through the plurality of recuperators, wherein the plural general heat exchangers include a first general heat exchanger and a second general heat exchanger, and the working fluid passing through the pump is heated by passing through the first general heat exchanger and the second general heat exchanger to be respectively transferred from the first and second general heat exchangers to each of the low temperature turbine and the high temperature turbine.

10. The supercritical $CO_2$ generation system of claim 8, wherein the working fluids passing through the first constrained heat exchanger and the second constrained heat exchanger are introduced into the turbines.

11. The supercritical $CO_2$ generation system of claim 4, further comprising a cooler provided to a front end of the pump and configured to cool the working fluid passing through the plurality of recuperators, wherein the plural general heat exchangers include a first general heat exchanger and a second general heat exchanger, and the working fluid passing through the pump is heated by passing through the first general heat exchanger and the second general heat exchanger to be respectively transferred from the first and second general heat exchangers to each of the low temperature turbine and the high temperature turbine.

12. The supercritical $CO_2$ generation system of claim 1, wherein the working fluid supplied to the at least one of the plural general heat exchangers is supplied from the pump respectively to each of the at least one plural general heat exchangers via a control valve provided to an inlet end of each general heat exchanger.

13. A supercritical $CO_2$ generation system using plural heat sources including plural constrained heat sources in which an emission regulation condition of emitted waste heat gas is defined and plural general heat sources in which the emission regulation condition is not defined, comprising:

a pump configured to circulate a working fluid;

a plurality of heat exchangers respectively configured to heat the working fluid using the plural heat sources, the plurality of heat exchangers including plural constrained heat exchangers that are respectively connected to the plural constrained heat sources and that each include an outlet end for discharging waste heat gas according to the emission regulation condition, and plural general heat exchangers that are respectively connected to the plural general heat sources and that each include an outlet end for outputting waste heat gas irrespective of the emission regulation condition;

turbines configured to be driven by the working fluid heated by passing through the plurality of heat exchangers, the turbines including a low temperature turbine driving the pump and a high temperature turbine driving a power generator;

recuperators configured to be introduced with the working fluid passing through the turbines and exchange heat between the working fluid passing through the turbines and the working fluid passing through the pump to cool the working fluid passing through the turbines; and transfer tubes configured to supply the working fluids passing through each of the low temperature turbine and the high temperature turbine to each of the recuperators, respectively, wherein the working fluid is supplied to the plural constrained heat exchangers by passing through the recuperators, respectively, and to at least one of the plural general heat exchangers without passing through the recuperators.

14. The supercritical $CO_2$ generation system of claim 13, wherein the emission regulation condition is a temperature condition.

15. The supercritical $CO_2$ generation system of claim 13, wherein the recuperators include a number of recuperators that is not more than a number of the plural constrained heat exchangers.

16. The supercritical $CO_2$ generation system of claim 13, wherein the plural constrained heat exchangers include a first constrained heat exchanger and a second constrained heat exchanger, and wherein, when the emission regulation condition of one of the first constrained heat exchanger or the second constrained heat exchanger is a temperature higher than that of the other, the plural constrained heat exchangers are connected to the transfer tubes such that a working fluid $mt_2$ passing through the high temperature turbine is transferred to the recuperator of the constrained heat exchanger of the higher temperature.

17. The supercritical $CO_2$ generation system of claim 16, further comprising a cooler provided to a front end of the pump and configured to cool the working fluid passing through the recuperators, wherein the plural general heat exchangers include a first general heat exchanger and a second general heat exchanger.

18. The supercritical $CO_2$ generation system of claim 17, wherein the working fluid passing through the pump is heated by passing through the first general heat exchanger and the second general heat exchanger to be respectively transferred from the first and second general heat exchangers to each of the low temperature turbine and the high temperature turbine.

19. The supercritical $CO_2$ generation system of claim 18, wherein the working fluids passing through the first constrained heat exchanger and the second constrained heat exchanger are introduced into the turbines.

20. The supercritical $CO_2$ generation system of claim 18, wherein the working fluid supplied to the at least one of the plural general heat exchangers is supplied from the pump respectively to each of the at least one plural general heat exchangers via a control valve provided to an inlet end of each general heat exchanger.

* * * * *